United States Patent [19]

Larson

[11] 4,299,171

[45] Nov. 10, 1981

[54] DEMOUNTABLE FLUME AMUSEMENT RIDE

[75] Inventor: Howard L. Larson, San Mateo, Calif.

[73] Assignee: Arrow Huss Inc., Mountain View, Calif.

[21] Appl. No.: 107,142

[22] Filed: Dec. 26, 1979

[51] Int. Cl.[3] ..... A63G 21/18

[52] U.S. Cl. ..... 104/70; 52/309.16; 238/10 F; 272/56.5 R; 405/121

[58] Field of Search ..... 272/56.5 R, 56.5 SS; 104/59, 69, 70, 72, 73, 134, 135, 136; 193/2 R, 2 A; 405/118, 119, 120, 121, 122, 123, 124, 125, 126; 52/309.2, 309.16, 169.7

[56] References Cited

U.S. PATENT DOCUMENTS

| | | | |
|---|---|---|---|
| 1,003,759 | 9/1911 | Lauritzen | 405/124 X |
| 3,149,187 | 9/1964 | Wood | 52/309.16 X |
| 3,302,949 | 2/1967 | Wolfe | 104/73 X |
| 3,807,105 | 4/1974 | Rudkin, Jr. et al. | 52/80 X |
| 3,879,240 | 4/1975 | Wall | 52/309.2 X |
| 4,149,710 | 4/1979 | Rouchard | 272/56.5 R |
| 4,198,043 | 4/1980 | Timbes et al. | 104/70 X |

FOREIGN PATENT DOCUMENTS

| | | | |
|---|---|---|---|
| 54-104025 | 8/1979 | Japan | 52/309.16 |
| 337805 | 11/1930 | United Kingdom | 104/73 |

*Primary Examiner*—Richard C. Pinkham
*Assistant Examiner*—Arnold W. Kramer
*Attorney, Agent, or Firm*—Limbach, Limbach & Sutton

[57] ABSTRACT

A flume of the type designed to carry a stream of water in which passenger carrying vessels float is built in sections that are formed nearly exclusively by fiberglass, structural strength being provided by fiberglass box beams integrally formed with the trough.

5 Claims, 5 Drawing Figures

DEMOUNTABLE FLUME AMUSEMENT RIDE

BACKGROUND OF THE INVENTION

This invention relates generally to water flume amusement rides, and more particularly to an improved structure of the water flume itself.

Water flume rides have in recent years become a very popular part of large amusement parks. Typically, a water trough is provided from a high elevation to a lower elevation, with turns and sharp drops in elevation provided. Water is pumped up to the top of the trough and allowed to fall under the influence of gravity to the bottom of the trough. Passenger carrying boats are elevated from a passenger loading platform to the top of the trough and then allowed to be carried by the falling water to the bottom of the trough. The turns and drops in elevation give a thrilling ride for the passengers. Such rides have been sold by the Arrow Development Company of Mountain View, Calif., assignee of the present application, for a number of years and permanently installed in a number of large amusement parks. An example of such a ride is described in its U.S. Pat. No. 3,830,161. Such rides are permanent installations of welded steel reinforced water flume sections.

It is a principle object of the present invention to provide a water flume ride construction of lower costs, with trough sections of lighter weight and easy to assemble, and which can be readily disassembled for movement to a different site.

SUMMARY OF THE INVENTION

This and additional objects are accomplished by the present invention, wherein, briefly, water flume or trough sections made almost entirely of fiberglass are reinforced by integrally formed fiberglass box beams, thus making extensive steel reinforcement of a flume installation unnecessary. Since the trough supporting structure is formed as part of the trough itself, the flume is easily disassembled by detaching the trough sections from one another and removing them from the site. Such a structure also permits easy and rapid construction. The sections are joined together with integrally formed flanges in a manner leaving a notch for filling with a plastic sealer to make the section joints watertight, a sealer that can easily be removed upon disassembly of the flume sections.

Other objects, advantages and features of the various aspects of the present invention will become apparent from the following description of a preferred embodiment thereof which should be taken in conjunction with the accompanying drawings.

DESCRIPTION OF A PREFERRED EMBODIMENT

Figure 1:
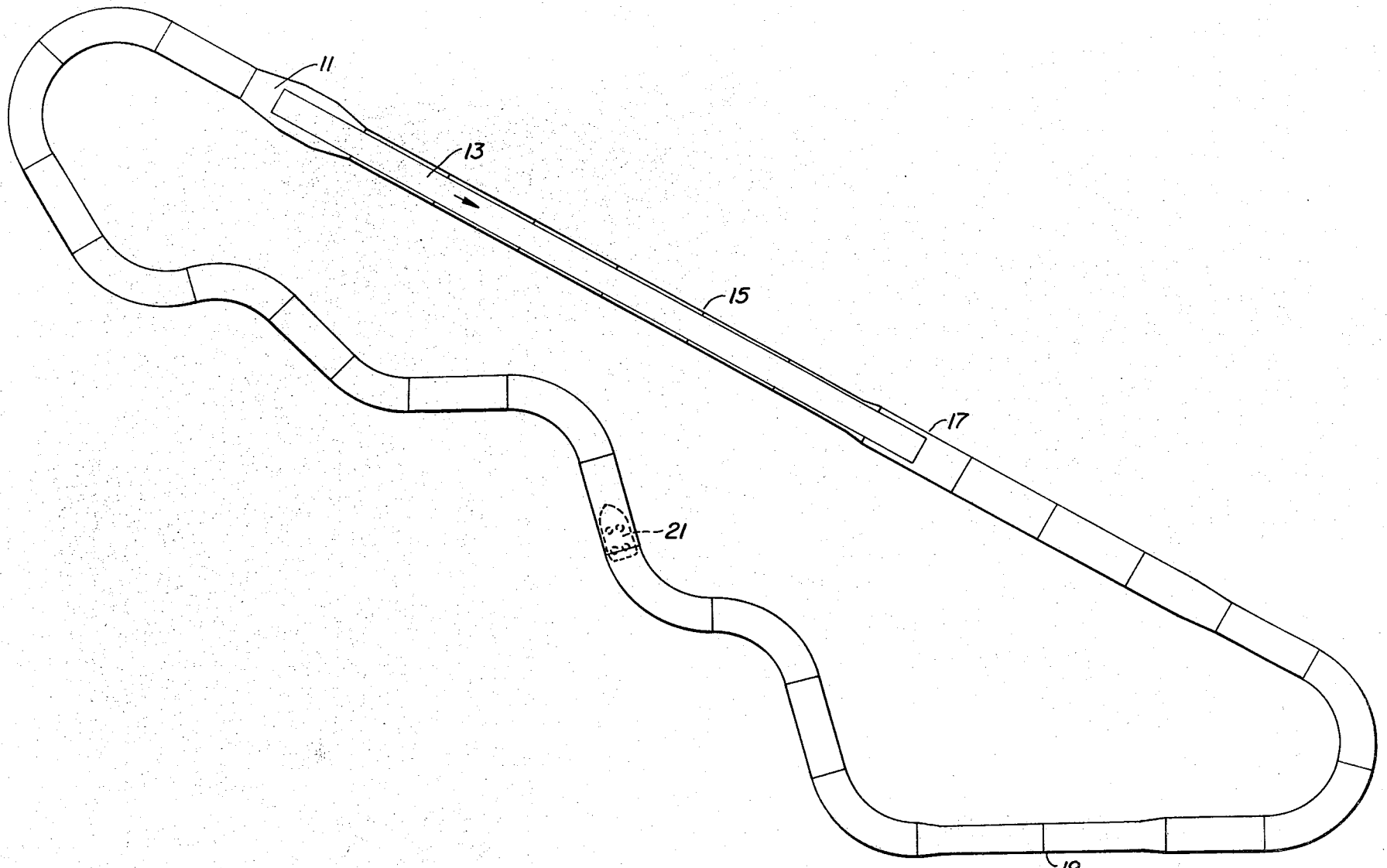
FIG. 1 shows in plan view a typical closed loop water flume ride in which the improved flume section construction is utilized.

Referring initially to FIG. 1, a closed loop water flume amusement ride is illustrated in plan view. The lowest elevational position 11 of the ride is at the lower end of a belt 13 that is mechanically driven in the direction shown to raise a boat from the position 11 to a highest position 15 of the entire ride. The continuously moving belt 13 drops in elevation somewhat from the position 15 until at a position 17 a boat carried thereby is released into the flowing water within the flume shown to carry the boat by gravity to a position 19 where a passenger loading station is located. Passenger loading station 19 is thus elevated from the point 11 and a passenger carrying boat 21 descends under the influence of water traveling from the position 19 to the position 11 by gravity. Water is pumped from the position 11 to the position 17 by an appropriate pumping means, not shown.

FIG. 1 illustrates that the flume ride is made up of a plurality of different trough sections connected end-to-end to form a continuous flume. Some of the sections are straight and others are curved to various extents. With standard straight and curved trough sections, a number of different flume layouts can be easily constructed without having to make very many special trough sections or other equipment.

Figure 2:
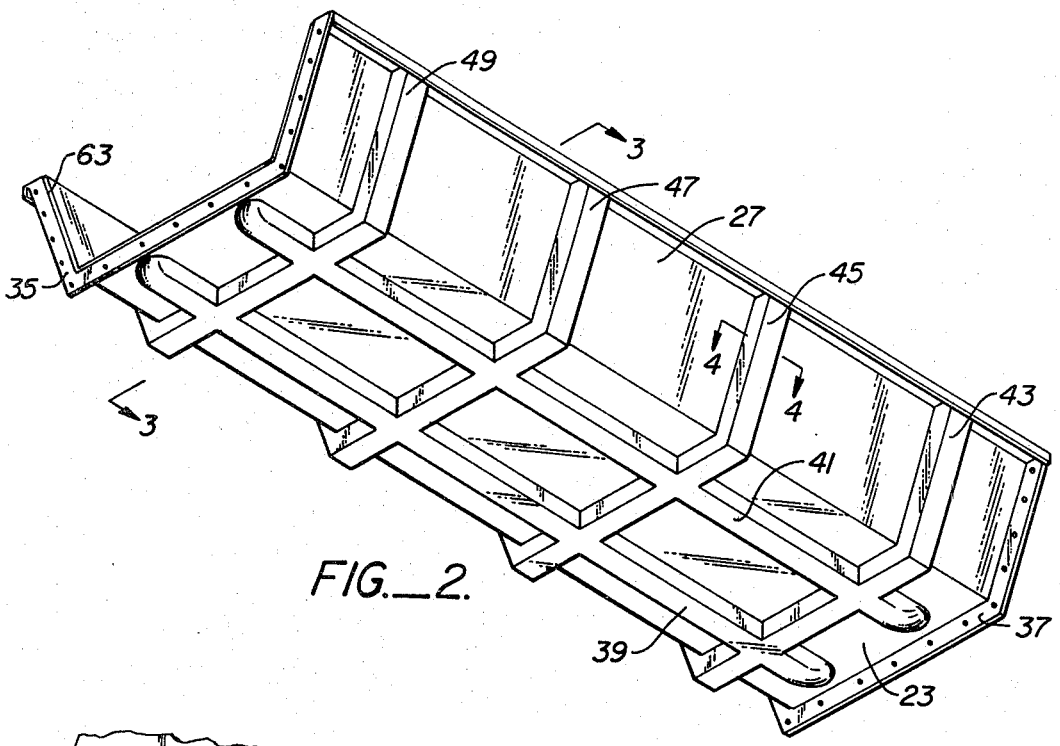
FIG. 2 is a perspective view of the underside of one such improved flume section.
Figure 4:
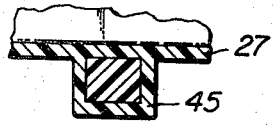
FIG. 4 is a sectional view of the trough of FIG. 2 taken at Section 4—4 thereof.
Figure 3:
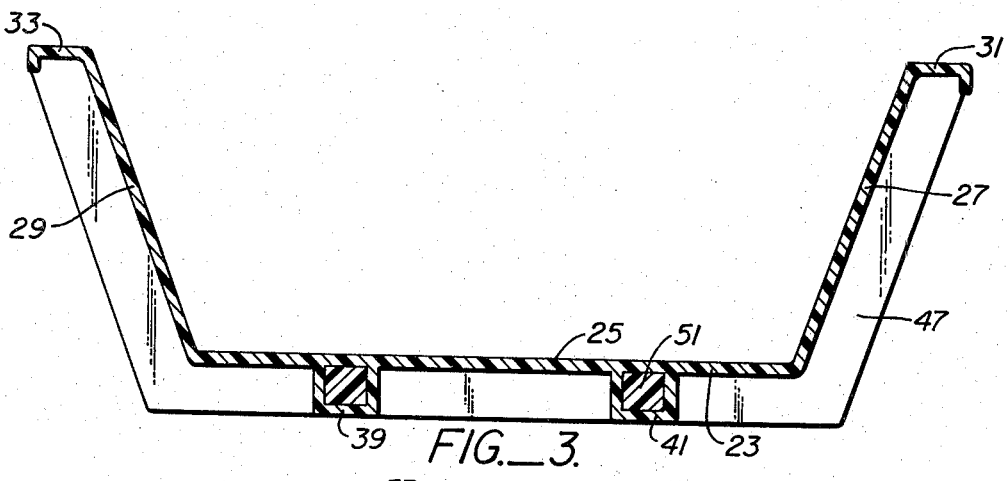
FIG. 3 is a sectional view of the trough of FIG. 2 taken at Section 3—3 thereof.

FIGS. 2, 3 and 4 show, as an example for illustration, a straight trough segment constructed according to the various techniques of the present invention. The same structural configuration is applied to curved trough sections but, of course, various portions thereof are curved rather than straight. The trough section of FIG. 2 includes as its various components, made as an integral structure from fiberglass, an elongated rectilinear bottom portion 23 which has a top surface 25 that contacts and carries the flowing water (not shown). Straight sidewalls 27 and 29 extend upward from the long edges of the bottom 23 to terminate along their top edges in horizontal shelves 31 and 33. The ends of the section of FIGS. 2–4 have a given shape corresponding to that of a number of sections so that they may be interchangeably connected, depending on a specific flume configuration desired. Accordingly, the end openings of the section of FIGS. 2–4 are of the same shape and contain flanges 35 and 37. These flanges depend away from the water carrying surfaces of the bottom 23 and the sides 27 and 29 in a direction substantially perpendicular to these surfaces. The flanges have a number of holes positioned in the same locations for bolting to adjacent sections as shown in FIG. 5.

In order to strengthen the fiberglass bottom and side sheets, fiberglass box beams 39 and 41 are provided on the underside of the bottom sheet 23 and cross box beams 43, 45, 47 and 49 are provided continuously from a position behind one side sheet 27 adjacent or coincident with the top ledge 31, across the underside of the bottom sheet 23 and up the backside of the other side sheet 29 to terminate at a position near or coincident with the top edge 33. Each of the beams 39 and 41 are shown in FIG. 2 to terminate at a position close to the end flanges 35 and 37 but can, if desired, be continued to terminate at those flanges.

The construction of each of these box beams is the same. The box beam 41, for example, is filled with a square cross section elongated foam plastic or lightweight wood material piece 51. This beam centerfill material, utilized in each of the beams of FIGS. 2–4, serves as a form only and provides no strength to the structure. That is why it is desired to make the material lightweight since it is not convenient to remove it after the fiberglass structure has been formed, although removal is a possibility. Each of the beams is formed integrally with the bottom and sidewalls 23, 27 and 29. The walls, beams and end flanges are formed according to standard fiberglass techniques, wherein glass fiber is placed over a form and resin applied thereto, a strong structure resulting when the resin has cured. Several such layers are utilized. After at least one such layer of the side and bottom walls has been formed, the forms for the box beams, such as the filler 51, are laid over that first layer and another layer of fiber and resin are applied conforming to the shape of the backside of the trough section with the box beam center mold material in place. Additional layers of fiber and resin are added as necessary, according to standard fiberglass molding techniques. The result is a lightweight but yet very strong structure.

Figure 5:
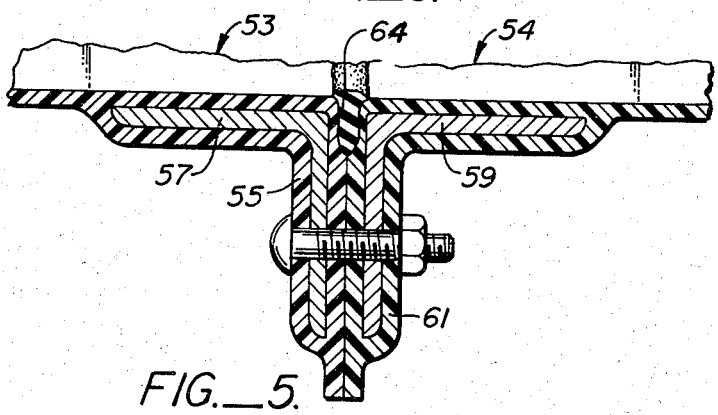
FIG. 5 is a sectional view of a joint between two flume sections, such as that illustrated in FIG. 2, when joined together.

Referring to FIG. 5, a sectional view is given through adjoining end flanges of two coupled trough segments 53 and 54. Optionally molded as part of a fiberglass end flange 55 is an angle iron 57 for added strength. Similarly, for the trough section 54, an angle iron 59 is molded as part of the end flange 61. The flanges are bolted together as illustrated. In order to provide a water-tight seal between sections, flexible sealing material, such as silicone rubber, is positioned as a bead 64 within a groove that results between the end flanges 55 and 61 by design. Each of these flanges has the corner of the flange and the bottom surface of the trough cut away for a short distance in the form of a groove, such as a groove 63 of the end flange 35 of the section of FIG. 2. When two such flanges are mated together, although a groove need be provided in only one flange, the groove is large enough to insert the sealing material bead 64. When the sections 53 and 54 are to be taken apart upon demounting the flume, the bead 64 is first removed and the flanges are then unbolted in order to release the individual sections. Except for the metal angle pieces 57 and 59 provided at each end of the trough section example being described, no other metal reinforcing or beams are required, the fiberglass box beams providing all the strength necessary. Of course, the number and placement of the fiberglass box beams depends upon the size and shape of the individual trough section.

Although the various aspects of the present invention have been described with respect to a preferred embodiment, it will be understood that the invention is entitled to protection within the full scope of the apended claims.

I claim:

1. For a water flume adapted to carry a stream of water in which passenger carrying vessels float and are carried thereby, a plurality of flume sections adapted to be connected together in order to form the water flume, each section comprising a fiberglass trough structure having a floor with opposing walls integrally formed therewith by fiberglass extending upward therefrom along its sides, both ends of said section having a given shaped opening for mating together with other of said sections to form the flume, an underside of the floor containing at least one structural beam extending along a significant portion of its length and at least one other structural beam extending across the underside of the floor and up the sides outside said trough, each of said beams being formed of fiberglass walls integrally with the section floor and sides and rectangular in cross-section with a non-structural material in a space enclosed by said walls.

2. The water flume and trough structure according to claim 1 which additionally comprises its said ends having a given shaped opening with a flange of fiberglass formed integrally with said bottom and sides and extending away from the trough interior surface at substantially a right angle therewith, at least one of said ends having a corner cut away to form a groove, whereby the joining of two such sections provides a groove in which a water sealant may be placed to seal the junction.

3. The structure according to claim 1 wherein said non-structural material is foam plastic.

4. The structure according to claim 1 wherein one of said walls of each of said beams includes a portion of the floor or side of the trough.

5. The structure according to any of claims 1, 3 or 4 wherein said at least one beam along the length of the trough and said at least one beam across the trough cross each other in an integrated structure.

* * * * *